US006590345B2

(12) United States Patent
Myoung et al.

(10) Patent No.: US 6,590,345 B2
(45) Date of Patent: Jul. 8, 2003

(54) LOW VOLTAGE OPERATION METHOD OF PLASMA DISPLAY PANEL AND APPARATUS THEREOF

(75) Inventors: Dae Jin Myoung, Koyang (KR); Jun Yeong Yoo, Seoul (KR); Byoung Kuk Min, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/934,470

(22) Filed: Aug. 23, 2001

(65) Prior Publication Data

US 2002/0047589 A1 Apr. 25, 2002

(30) Foreign Application Priority Data

Aug. 24, 2000 (KR) ..... 2000-49372

(51) Int. Cl.[7] ..... G09G 3/10
(52) U.S. Cl. ..... 315/167.4; 315/169.4
(58) Field of Search ..... 315/167.4, 169.4, 315/169.1, 169.2, 168; 345/68, 90, 60, 61, 62, 63, 66, 74.1, 76; 313/484, 491, 514

(56) References Cited

U.S. PATENT DOCUMENTS 5,744,909 A * 4/1998 Amano ..... 313/585
6,208,084 B1 * 3/2001 Urakabe et al. ..... 315/169.4
6,271,810 B1 * 8/2001 Yoo et al. ..... 345/60

* cited by examiner

*Primary Examiner*—James Clinger
(74) *Attorney, Agent, or Firm*—Fleshner & Kim, LLP

(57) ABSTRACT

In a low voltage operation method of a PDP (plasma display panel) and an apparatus thereof capable of maintaining a picture quality and operation efficiency although a minimum operation voltage is applied to a PDP, the low voltage operation method of the plasma display panel includes operating one frame by dividing it into several sub-fields in order to obtain a gray level of a PDP, dividing the sub-field into a reset period, an address period, a sustain period and supplying a ramp waveform in the reset period, and applying a DC biasing voltage in order to reduce wall electric charge discharged in descending of the ramp waveform.

9 Claims, 6 Drawing Sheets

LOW VOLTAGE OPERATION METHOD OF PLASMA DISPLAY PANEL AND APPARATUS THEREOF

BACKGROUND OF THE INVENTION

1. Field of the Invention

The present invention relates to a low voltage operation method of a plasma display panel and an apparatus thereof, and in particular to a low voltage operation method of a plasma display panel and an apparatus thereof which are capable of reducing a voltage supplied to an address by decreasing wall electric charge inside a cell in address discharge by applying a direct-current biasing voltage.

2. Description of the Prior Art

In a PDP (Plasma Display Panel), inside a discharge cell separated from bulkheads, red/green/blue colors fluorescent materials formed at the bulkheads are excited by ultraviolet rays generated in discharge of inert mixture of gas such as He—Ne or Ne—Xe, a character or a graphic is displayed by visible rays generated when the state of the fluorescent materials is changed from the excitation state to a ground state.

Because the PDP does not require an electron gun such as a cathode ray in order to display an image, it is thinner and lighter than a cathode ray tube and is favorable to high distinct and scale-up.

In addition, because the PDP includes electrodes, a dielectric layer, and discharge gas, etc. and is operated by charge and discharge, it has a function as a capacitor charging electric charge. Accordingly, the PDP consumes lots of energy in charging/discharging, the more the size of PDP increases, the more energy consumption of the PDP increases.

Accordingly, in order to consume energy more efficiently, three electrode AC surface discharge type PDP is used. In the three electrode AC surface discharge type PDP, because wall electric charge is accumulated at a surface, electrodes are prevented from sputtering occurred by discharge, therefore the three electrode AC surface discharge type PDP is favorable to a low voltage operation and having a long life span.

FIG. 1 is a perspective view illustrating a structure of the conventional surface discharge type PDP, and FIG. 2 is a sectional view illustrating a cell of the PDP as shown at FIG. 1. Herein, the conventional surface discharge type PDP includes an upper substrate 10, a scan electrode 20Y and a sustain electrode 20Z formed at the bottom surface of the upper substrate 10, an upper dielectric layer 30 accumulating wall electric charge generated in discharge of the PDP, a protecting layer 30 preventing the upper dielectric layer 30 from sputtering occurred in discharge of the PDP and heightening the discharge effect of secondary electron, a lower substrate 90, an address electrode 80X formed at the upper surface of the lower substrate 90, a lower dielectric layer 70 accumulating electric charge of the address electrodes 80X, a bulkhead 50 formed at the lower dielectric layer 70, and a fluorescent material 60 coated onto the bulkhead 50 and the lower dielectric layer 70.

The scan electrode 20Y and the sustain electrode 20Z respectively include transparent electrodes 22Y, 22Z and metal bus electrodes 21Y, 21Z. The metal bus electrodes 21Y, 21Z have a smaller line width than the transparent electrodes 22Y, 22Z, are formed at the edge of the transparent electrodes 22Y, 22Z and reduce voltage drop due to high resistance of the transparent electrodes 22Y, 22Z.

The upper dielectric layer 30 and the protecting later 40 are laminated onto the upper substrate 10 in which the scan electrode 20Y and the sustain electrode 20Z are formed. The upper dielectric layer 30 accumulates the wall electric charge generated in discharge of the PDP, the protecting layer 40 prevents the upper dielectric layer 30 from sputtering occurred in discharge of the PDP and improves the discharge efficiency of the secondary electron.

The lower dielectric layer 70 and the bulkhead 50 are laminated onto the lower substrate 90, and the fluorescent material 60 is coated onto the surface of the lower dielectric layer 70 and the bulkhead 50.

The address electrodes 80X formed at the lower substrate 90 are placed so as to be crossed with the scan electrode 20Y and the sustain electrode 20Z, and the bulkhead 50 is placed so as to be crossed with the address electrodes 80X in order to prevent ultraviolet and visible rays generated in discharge from leaking into an adjacent discharge cell.

Because the fluorescent material 60 is excited by ultraviolet rays generated in discharge of the PDP, one visible ray of red/green/blue is generated and inert mixture of gas such as He—Ne or He—Xe for discharge is injected into a discharge space of the discharge cell formed between the upper/lower substrates 10, 90 and the bulkhead 50.

The above-described three electrode AC surface discharge type PDP operates one frame by dividing it into several sub-fields having different luminous times in order to obtain gray level of a picture.

Each of the sub-fields is divided into a reset period for occurring discharge regularly, an address period for selecting a discharge cell and a sustain period for obtaining a gray level according to the discharge times.

For example, in order to display a picture with 256 gray level, a frame period (16.67 ms) corresponded to 1/60 second is divided into eight sub-fields (SF1~SF8), the eight sub-fields (SF1~SF8) are divided into a reset period, an address period and a sustain period. The reset period and the address period of each sub-field are same, however the sustain period increases as a rate of $2^n$ (n=0, 1, 2, 3, 4, 5, 6, 7). Because the sustain period is different in each sub-field, the gray level of the picture can be obtained.

In the above-described sub-field, an operation waveform supplied to the three electrode AC surface discharge type PDP will be described with reference to accompanying FIGS. 3A–3C.

FIGS. 3A–3C are waveform diagrams illustrating an operation waveform supplied to the three-way AC surface discharge type PDP in a sub-field according to the conventional art, the PDP operates one sub-field by dividing it into the reset period, the address period and the sustain period.

In the reset period, an ascending ramp waveform (ramp 1) and a descending ramp waveform (ramp 2) are supplied consecutively.

When the ascending ramp waveform (ramp 1) is supplied, weak discharge occurs between the scan electrode 20Y and the sustain electrode 20Z, and wall electric charge is accumulated at the upper dielectric layer 30. When the descending ramp waveform (ramp 2) is supplied, an operational margin of an operation circuit can be obtained sufficiently by removing the wall electric charge inside the cell appropriately.

By supplying the ramp waveform to the scan electrode 20Y for the reset period, a contrast ratio is increased by decreasing visible rays as many as possible for the reset period as a non-display period, and an operation voltage required for the address discharge is lowered by forming the wall electric charge at the whole panel uniformly.

For the address period, an electrode negative data pulse is supplied to the address electrode 80X, and an electrode positive scan pulse is sequentially supplied to the scan electrode 20Y in order to synchronize with the data pulse. The cell supplied the data pulse is address-discharged by being added the voltage corresponded to the voltage difference between the data pulse and the scan pulse and the internal wall voltage accumulated by the wall electric charge inside the cell.

For the sustain period, a sustain pulse is supplied to the scan electrode 20Y and the sustain electrode 20Z by turns, cells selected by the address discharge performs a sustain discharge whenever the sustain pulse is supplied. After all the sustain discharge according to a luminance relative ratio occurs, an erase signal having a chopping wave shape is supplied to the sustain electrode 20Z.

As described above, by discharging the wall electric charge inside the cell for the reset period, the voltage required for the address discharge is lowered.

However, in order to perform the address discharge, because a voltage not less than 60W is required, power for operating the PDP is consumed a lot. And, because parts suitable for the high voltage operation are expensive, a fabrication cost is increased.

In addition, because the number of wall electric charges is decreases in the high voltage, operation efficiency of the PDP is lowered.

SUMMARY OF THE INVENTION

It is an object of the present invention to provide a low voltage operation method of a plasma display panel and an apparatus thereof which are capable of lowering a voltage supplied from outside as an optimum level in address discharge by applying a DC biasing voltage to a PDP (Plasma Display Panel).

In order to achieve the above-mentioned object, a low voltage operation method of a plasma display panel in accordance with the present invention includes operating one frame by dividing it into several sub-fields in order to obtain a gray level of a PDP, dividing the sub-field into a reset period, an address period, a sustain period and supplying a ramp waveform in the reset period, and applying a DC biasing voltage in order to reduce wall electric charge discharged in descending of the ramp waveform.

In order to achieve the above-mentioned object, a low voltage operation apparatus of a plasma display panel in accordance with the present invention includes a plasma display panel, a maintenance operation unit being supplied a sustain voltage, a biasing voltage supplying unit supplying a DC biasing voltage, a first switch controlling a voltage applied from the biasing voltage supplying unit, a second switch controlling the operation of a reset voltage, a third switch controlling a voltage supplied from the first switch and the second switch, a fourth switch controlling supply of a scan voltage, and an operation intergrated circuit connected to a scan electrode.

DETAILED DESCRIPTION OF THE PREFERRED EMBODIMENT

Figure 1:
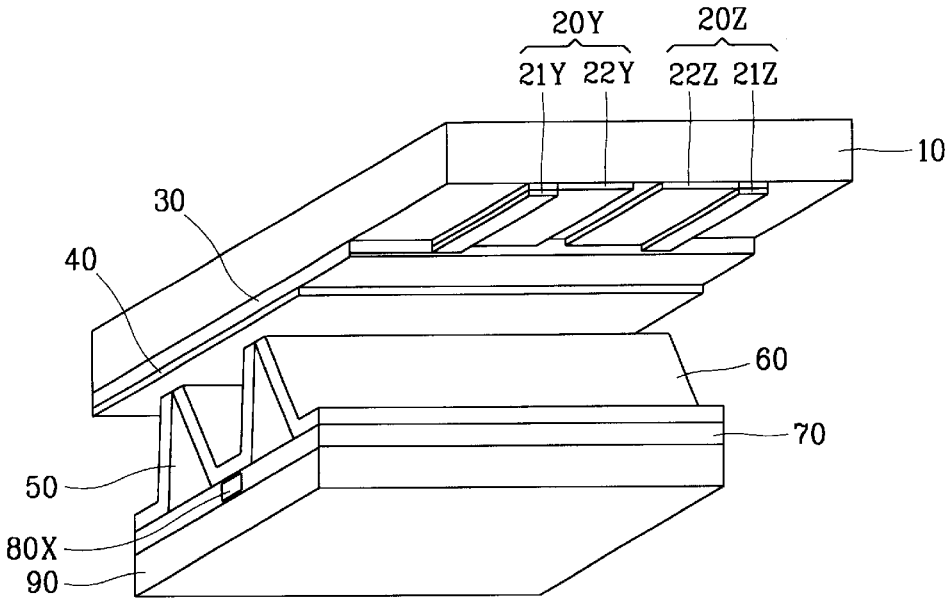
FIG. 1 CONVENTIONAL ART
FIG. 1 is a perspective view illustrating a structure of a discharge type PDP (Plasma Display Panel) according to the prior art.
Figure 2:
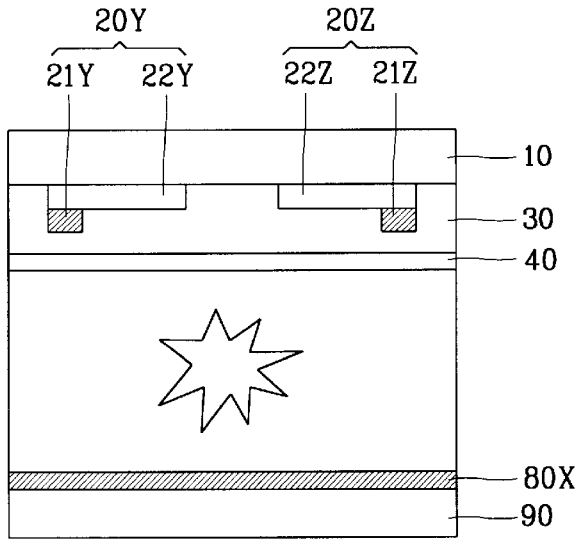
FIG. 2 CONVENTIONAL ART
FIG. 2 is a sectional view illustrating a cell of the PDP as shown at FIG. 1.
Figures 3A, 3B, 3C:
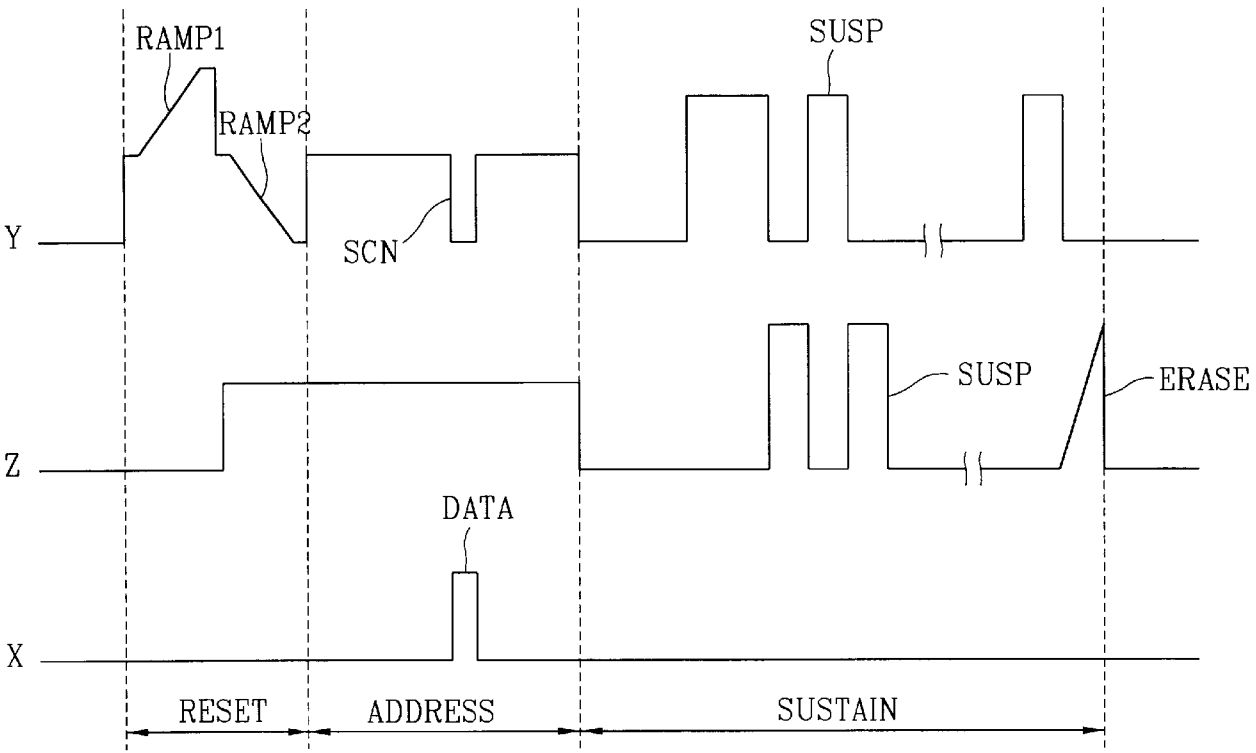
FIG. 3A CONVENTIONAL ART
FIG. 3B CONVENTIONAL ART
FIG. 3C CONVENTIONAL ART
FIGS. 3A–3C are waveform diagrams illustrating an operation waveform supplied to a three electrode AC surface discharge type PDP in a sub-field according to the prior art.
Figure 4:
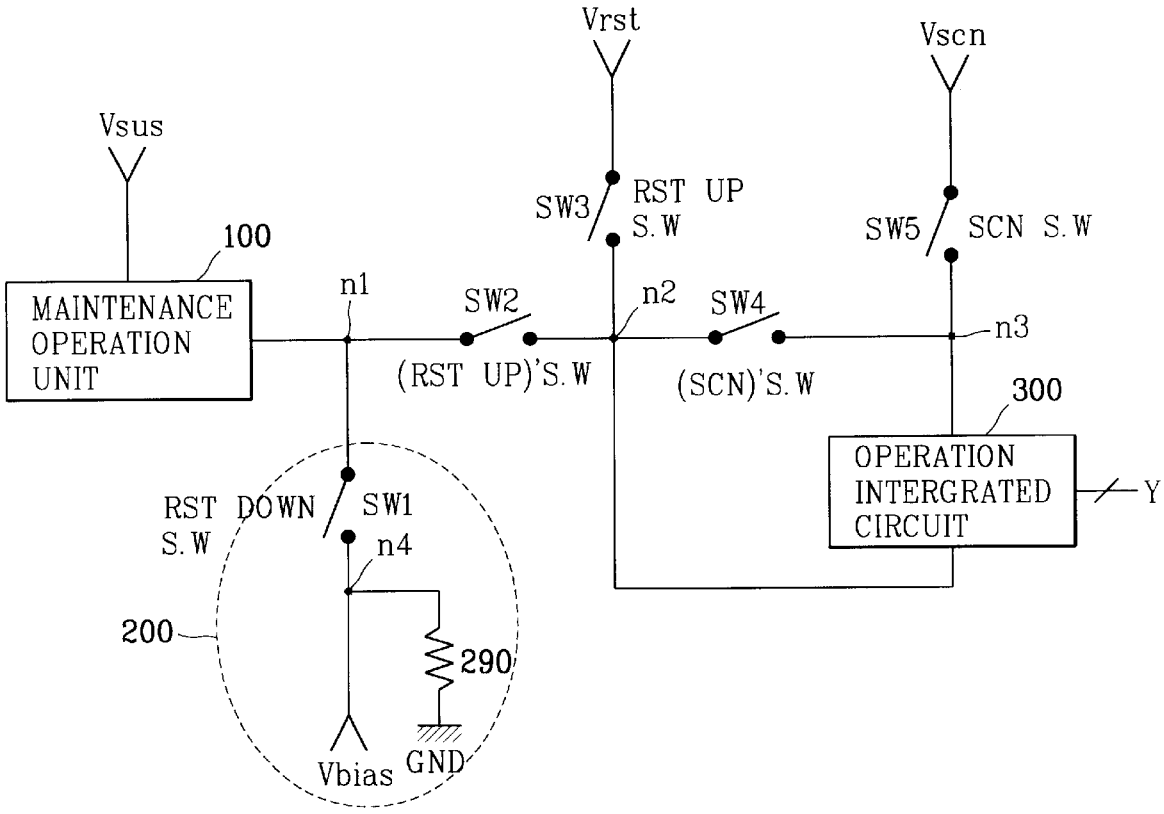
FIG. 4 is a circuit diagram illustrating a scan electrode operation unit of a PDP in accordance with the present invention.

FIG. 4 is a circuit diagram illustrating a scan electrode operation unit of a PDP in accordance with the present invention, a scan electrode operation unit of a PDP in accordance with the present invention includes a maintenance operation unit 100 being supplied a sustain voltage (Vsus), a biasing voltage supplying unit 200 being supplied a DC biasing voltage, a reset up switch (sw3) controlling supply of a reset voltage (Vrst), a scan switch (sw5) controlling supply of the scan voltage (Vscan), an operation intergrated circuit 300 connected to a scan electrode (Y), a reset up reverse switch (sw2) connected between a first node (n1) and a second node (n2), and a scan reverse switch (sw4) connected between the second node (n2) and a third node (n3).

The biasing voltage supplying unit 200 is constructed with a reset down switch (sw1) connected between a biasing voltage supplier and a first node (n1) and a resistance 290 connected between a fourth node (n4) and a ground voltage (GND). The resistance 290 stabilizes the biasing voltage (Vbias) supplied to the fourth node (n4).

The construction of the biasing voltage supplying unit 200 will be described in detail with reference to accompanying FIG. 5.

Figure 5:
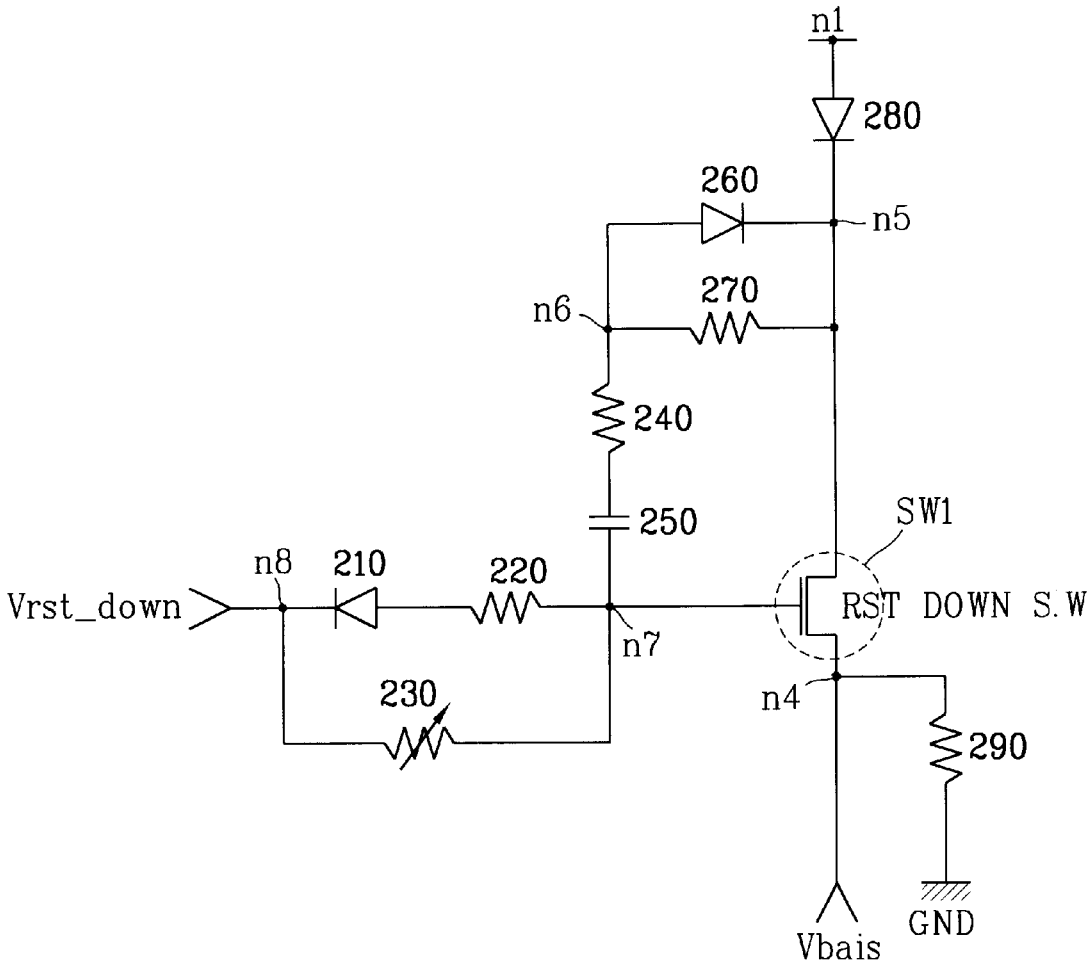
FIG. 5 is a detailed circuit diagram illustrating a voltage supplying unit as shown in FIG. 4.
Figures 6A, 6B, 6C, 6D, 6E, 6F, 6G, 6H:
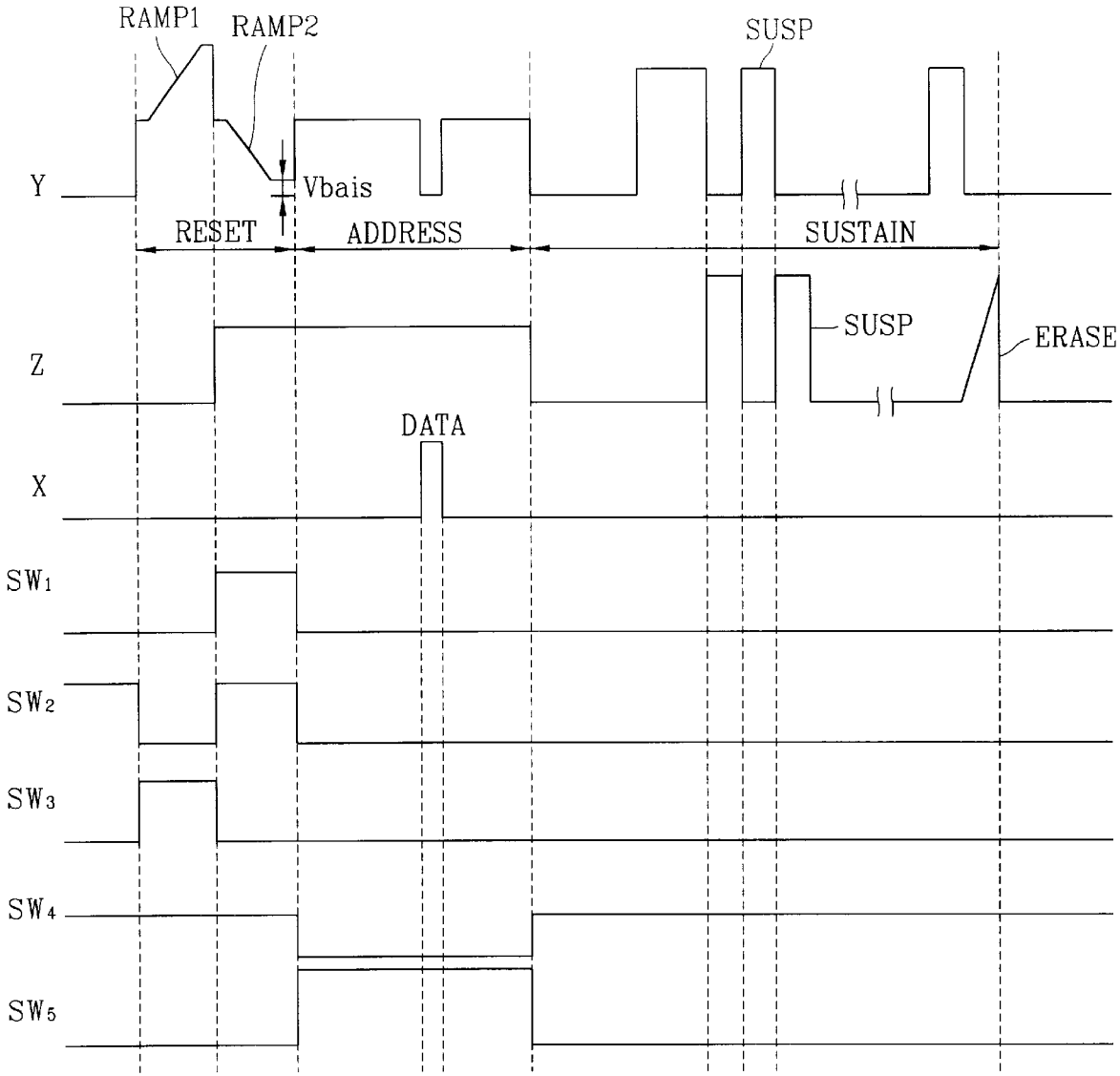
FIGS. 6A–6H are waveform diagrams illustrating a low voltage address operation method of a plasma display panel according to the present invention.

FIG. 5 is a detailed circuit diagram illustrating the biasing voltage supplying unit as shown in FIG. 4. The biasing voltage supplying unit 200 includes a first diode 210 and a first resistance 220 being supplied a reset down control signal, a variable resistance 230 parallel-connected to the first diode 210 and the first resistance 220, a reset down switch (sw1) parallel-connected to the variable resistance 230, a third diode 280 serial-connected to the reset down switch (sw1), a second diode 260 and a fourth resistance 270 parallel-connected to the third diode 280, the second diode 260 and the fourth resistance 270, a third resistance 240 and a condenser 250 serial-connected to the first resistance 220, and a fifth resistance 290 stabilizing the biasing voltage supplied to the reset down switch (sw1).

The diodes 210, 260, 280 prevent reverse currents of inputted currents, the third resistance 240 and the fourth resistance 270 stabilize a voltage inputted from the first node (n1) through the third diode (280), and the first resistance stabilizes a voltage of a seventh node (n7) as a cross point of the reset down switch (sw1) and the condenser 220.

The variable resistance 280 and the condenser 250 determine descendent of a ramp waveform inputted to a scan electrode (Y) of the plasma display panel for the reset period by time constants.

The reset down switch (sw1) uses MOSFET of a N channel, it can use also a different kind of transistor capable of switching control.

The operation method of the plasma display will be described in detail with reference to accompanying FIGS. 4, 5 and 6A–6H.

FIGS. 6A–6H are waveform diagrams illustrating a low voltage address operation method of a plasma display panel according to the present invention, herein one sub-field operable the PDP is divided into a reset period, an address period and a sustain period.

At the initial time point of the reset period, the reset up reverse switch (sw2) and the scan reverse switch (sw3) are turned on, the reset down switch (sw1), the reset up switch (sw3) and the scan switch (sw5) are turned off, the sustain voltage (Vsus) generated in the maintenance operation unit (sw3) is inputted to the operation intergrated circuit 300 and supplied to the scan electrode Y. When the sustain voltage (Vsus) is inputted, the voltage of the scan electrode (Y) rises same as the sustain voltage (Vsus).

When the scan electrode (Y) rises so as to be same as the sustain voltage (Vsus), the reset up switch (sw3) is turned on, the reset up reverse switch (sw2) is turned off, and the voltage of the scan electrode (Y) rises same as the reset voltage.

When the ascent ramp waveform (ramp 1) is supplied to the scan electrode (Y), weak discharge occurs between the scan electrode (Y) and the sustain electrode (Z), by the discharge, the wall electric charge accumulates at the scan electrode (Y) and the sustain electrode (Z).

When the wall electric charge is accumulated uniformly, the reset up switch (sw3) is turned off, the reset up reverse switch (sw2) and the reset down switch (sw1) are turned on, and the DC biasing voltage (Vbias) is supplied to the scan electrode (Y).

By the DC biasing voltage, the scan electrode (Y) declines same as the DC biasing voltage (Vbais) as the slope of the descent ramp waveform (ramp 2) determined by the time constants of the variable resistance 280 and the condenser 250.

In the slope of the descent ramp waveform (ramp 2), it is favorable to have a threshold value as small as possible, when the slope is too big, the wall electric charge can not be uniformly accumulated at the scan electrode (Y) and the sustain electrode (Z), because the address discharge is performed irregularly, the waveform is unstable.

The descent ramp waveform (ramp 2) does not decline to the ground voltage (GND) but to the electrode negative of the DC biasing voltage (Vbias), the voltage level is smaller than the ascent ramp waveform (ramp 1), and the minimum wall electric charge not required for the address discharge is removed.

In more detail, because the voltage level of the descent ramp waveform (ramp 2) is small as the DC biasing voltage (Vbias), the wall electric charge is removed as small as the voltage, the wall electric charge remained inside the cell increases, and the wall voltage inside the cell is increased before the address discharge, accordingly the voltage of the data pulse and the scan pulse required for the address discharge can be decreased.

For the address period, the electrode negative data pulse is supplied to the address electrode (X). The scan switch (sw5) is turned on by synchronizing with the data pulse, when the scan reverse switch (sw3) is turned off, the scan pulse is supplied to the scan electrode (Y) by synchronizing with the data pulse. The cell supplied the data pulse is address-discharged by being added the voltage corresponded to the voltage difference between the data pulse and the scan pulse and the wall voltage inside the cell.

The more the value of the scan pulse and the data pulse are small, the more the external voltage applied to the PDP (Plasma Display Panel) for the address discharge are small.

For the sustain period, the sustain pulse is supplied to the scan electrode (Y) and the sustain electrode (Z) by turns.

The cells selected by the address discharge perform the sustain discharge whenever the sustain pulse is supplied, after all the all sustain discharge are performed, the small erase signal having the chopping wave is supplied to the common sustain electrode (Z).

In the DC biasing voltage (Vbias), because the address operation margin is reduced as same as the erase quantity of the wall electric charge, the size of the DC biasing voltage is determined by considering the address operation margin.

In other words, when the DC biasing voltage (Vbias) is set so as to be not less than a certain amount, because the wall voltage inside the cell not being supplied the data is big, the address discharge can occur in the un-requested cell.

In order to solve the above-mentioned problems, the DC biasing voltage is applied for the address period.

It will be described in more detail with reference to accompanying FIGS. 7A–7C.

Figures 7A, 7B, 7C:
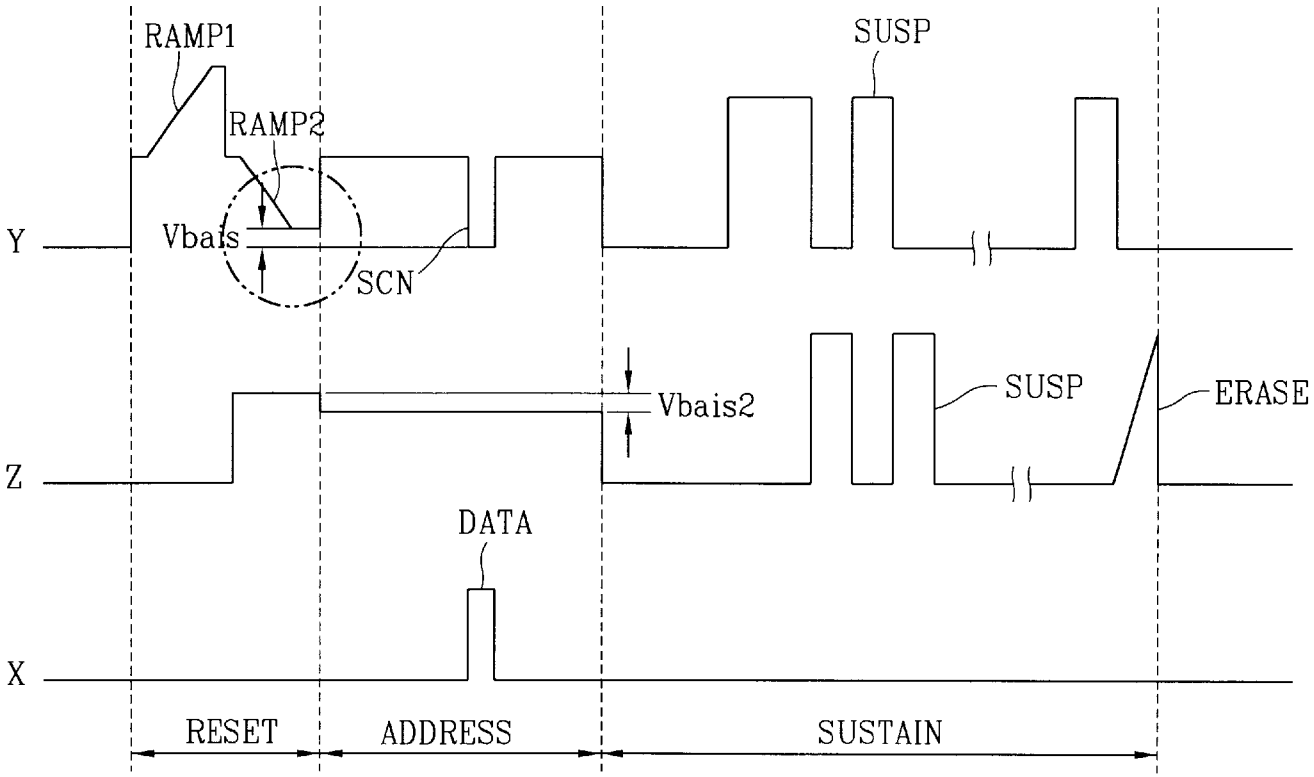
FIGS. 7A–7C are waveform diagrams illustrating a low voltage operation method of a plasma display panel according to the present invention.

FIGS. 7A–7C are waveform diagrams illustrating a low voltage operation method of a plasma display panel according to the present invention. By applying the DC biasing voltage to the sustain electrode (Z), the voltage on the sustain electrode (Z) is adjusted so as to be smaller for the reset period, and the DC biasing voltage supplied to the descent ramp waveform (ramp 2) can be set so as to be more higher for the reset period, accordingly the voltage required for the address discharge can be lowered.

As described above, in the low voltage operation method of the plasma display panel and the apparatus thereof in accordance with the present invention, by applying the DC biasing voltage to the scan electrode when the descent ramp waveform (ramp 2) is supplied to the scan electrode for the reset period, the voltage of the descent ramp waveform supplied to the scan electrode can be lowered, accordingly the wall electric charge removed for the reset period can be minimized. And, by increasing the wall voltage inside the cell in the address discharge, the external supply voltage required for the address discharge can be lowered, the power consumption can be reduced, and by using the low voltage parts, the fabrication cost can be reduced and it is favorable to miniaturization of the apparatus.

In addition, by lowering the voltage of the sustain electrode for the address period, because errors in address discharge due to the DC biasing voltage supplied to the descent ramp waveform can be prevented, although a low voltage is supplied in the address discharge, the address can operate stably.

In addition, because a low voltage operation circuit unit is obtained by using elements stabilizing the biasing voltage, a biasing voltage supplying unit can be easily obtained.

What is claimed is:

1. A method comprising:

supplying a ramp waveform in a reset period to a scan electrode; and applying a first DC biasing voltage to the scan electrode in a descending portion of the ramp waveform.

2. The method of claim 1, wherein the supplying the ramp waveform comprises:

supplying a sustain voltage to the scan electrode, wherein the sustain voltage is generated from a maintenance operation unit at an early stage of the reset period to the scan electrode; and supplying a reset voltage to the scan electrode by turning a reset up switch on when a voltage of the scan electrode rises to the same level as the sustain voltage.

3. The method of claim 2, wherein the supplying the reset voltage includes:

accumulating wall electric charge by generating weak discharge between the scan electrode and a sustain electrode when the scan electrode rises up to the reset voltage.

4. The method of claim 2, wherein the ramp waveform comprises a rising portion, when a sustain electrode is at a low level.

5. The method of claim 1, wherein the applying the first DC biasing voltage includes:

applying the first DC biasing voltage to the scan electrode when a wall electric charge is accumulated at the scan electrode; and lowering a voltage of the scan electrode to the first DC biasing voltage during the descending portion of the ramp waveform.

6. The method of claim 1, wherein a minimum voltage level of the descending ramp waveform is greater than a minimum voltage level of the ascending ramp waveform voltage by the first DC biasing voltage.

7. The method of claim 1, wherein the first DC biasing voltage has a positive potential with respect to ground.

8. A low voltage operation apparatus of a plasma display panel, comprising:

a plasma display panel;

a maintenance operation unit being supplied a sustain voltage;

a biasing voltage supplying unit supplying a DC biasing voltage; and an operation integrated circuit connected to a scan electrode, wherein the biasing voltage supplying unit includes:

a reset down switch controlling a reset down control signal and a biasing voltage;

a reset down control unit supplying a reset down control signal; and a voltage stabilizer stabilizing the supplied biasing voltage.

9. The apparatus of claim 8, wherein the voltage stabilizer is constructed with a resistance for stabilizing the biasing voltage supplied to the scan electrode.

* * * * *